US005165558A

United States Patent [19]

Cargile

[11] Patent Number: 5,165,558

[45] Date of Patent: Nov. 24, 1992

[54] DISPENSER AND MEASURING CUP

[75] Inventor: David W. Cargile, Lancaster, Pa.

[73] Assignee: Graham Packaging Corporation, York, Pa.

[21] Appl. No.: 824,028

[22] Filed: Jan. 22, 1992

[51] Int. Cl.[5] ..... B65D 23/12

[52] U.S. Cl. ..... 215/100 R; 215/1 C; 215/100 A; 215/DIG. 5; 220/735

[58] Field of Search ..... 215/1 C, 100 R, 100 A, 215/DIG. 5, DIG. 7; 220/735, 736, 94 A

[56] References Cited

U.S. PATENT DOCUMENTS

| | | | |
|---|---|---|---|
| 1,240,072 | 9/1917 | Maiden | 215/100 R |
| 1,327,439 | 1/1920 | Lewis | 215/100 R |
| 1,706,815 | 3/1929 | Phillipson | 215/100 R |
| 2,438,434 | 3/1948 | Friedman | 220/735 X |
| 2,487,274 | 11/1949 | Schaffer | 215/100 R |
| 2,832,517 | 4/1958 | Baumgartner . | |
| 2,995,265 | 8/1961 | Soderberg | 215/100 R |
| 3,045,723 | 7/1962 | Gainor | 215/100 R |
| 3,080,081 | 3/1963 | Gram | 215/100 R |
| 3,526,313 | 9/1970 | Kull et al. . | |
| 4,055,292 | 10/1977 | Hosoya . | |
| 4,095,716 | 6/1978 | Meany | 215/100 R |
| 4,373,640 | 2/1983 | Resio . | |
| 4,903,848 | 2/1990 | Chattman | 215/227 |
| 4,964,522 | 10/1990 | Umetsu et al. . | |
| 5,092,476 | 3/1992 | Yasuda et al. | 215/100 A |

FOREIGN PATENT DOCUMENTS

| | | | |
|---|---|---|---|
| 606457 | 8/1948 | United Kingdom | 215/100 R |

*Primary Examiner*—Stephen Marcus
*Assistant Examiner*—Stephen Cronin
*Attorney, Agent, or Firm*—Howson & Howson

[57] ABSTRACT

A blow molded container having a break-away measuring and dispensing cup. In the disclosed embodiments, the cup is formed during molding from a web extending along a parting line of the blow-molded container body. The web has a weakened region which detachably connects the cup to the container. The cup can be reattached either on the container or its cap in a non-use stowage position.

24 Claims, 3 Drawing Sheets

FIG. 1
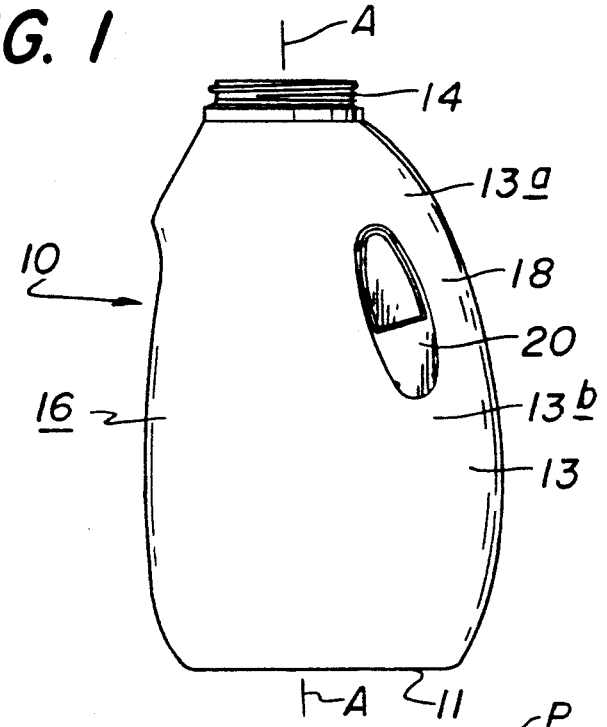
FIG. 2
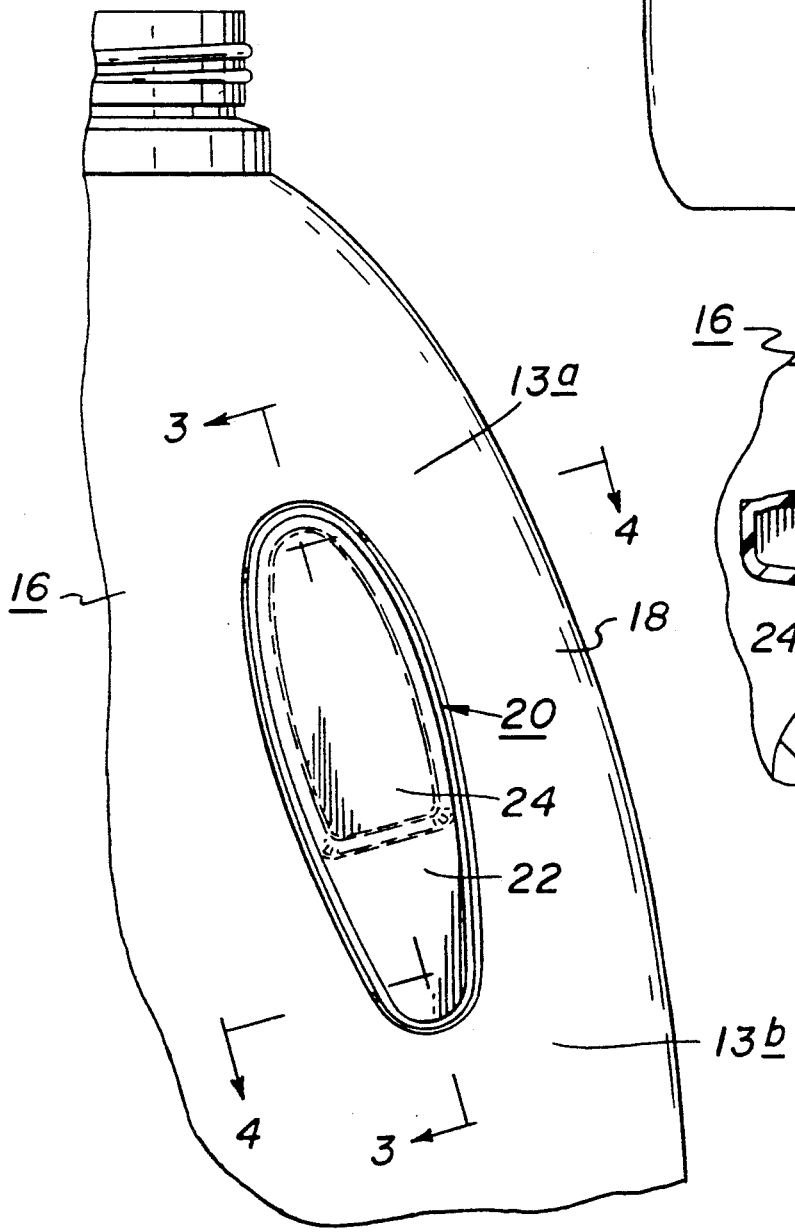
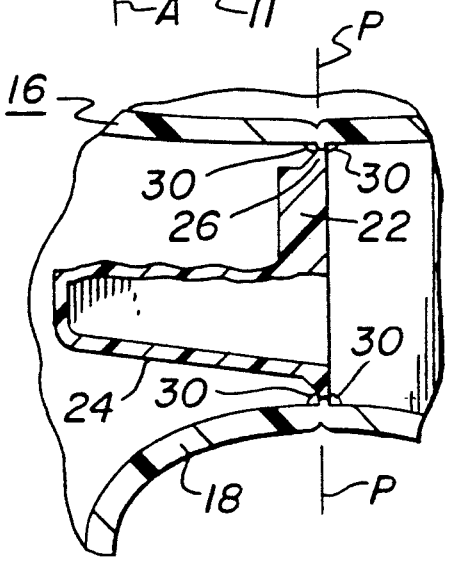
FIG. 6

FIG. 7
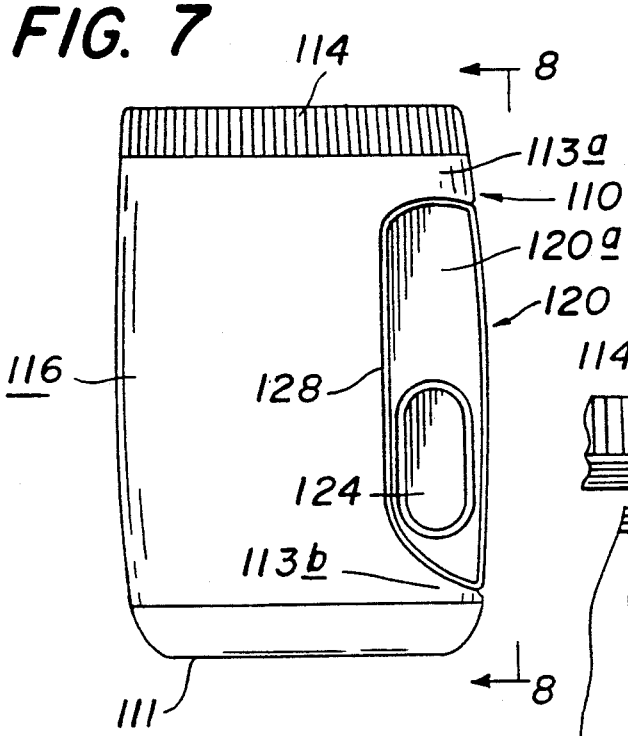
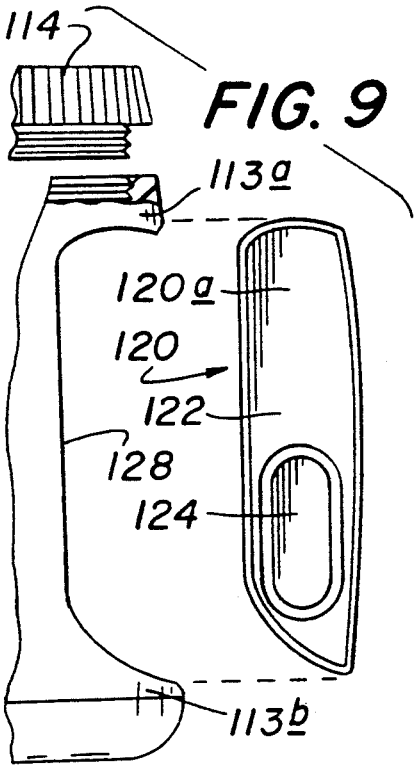
FIG. 9
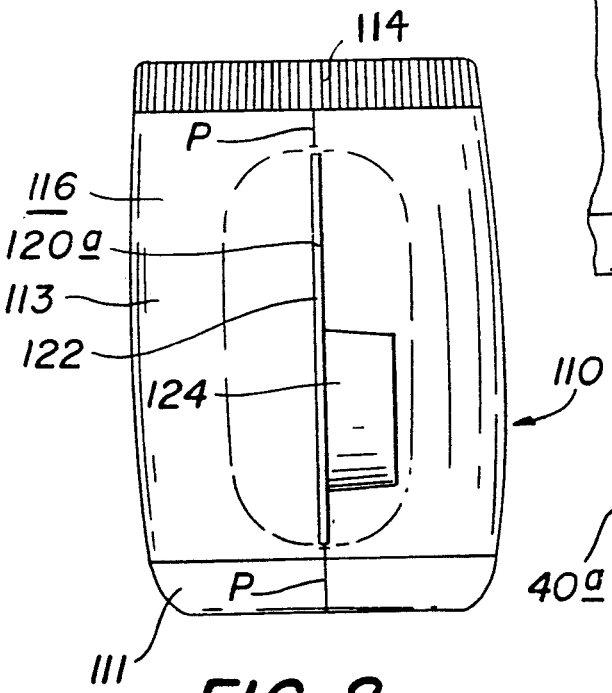
FIG. 8
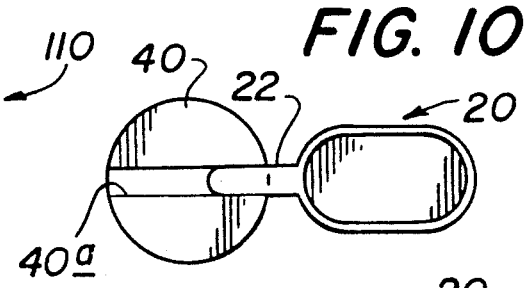
FIG. 10
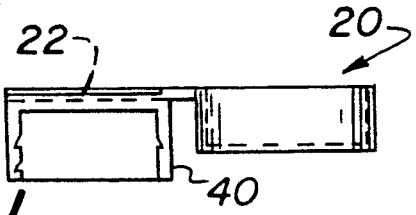
FIG. 11

DISPENSER AND MEASURING CUP

FIELD OF THE INVENTION

The present invention relates to dispensing containers having detachable accessories, and more particularly the present invention relates to a container having a break-away convenience cup for use in measuring and dispensing the contents of the container.

BACKGROUND OF THE INVENTION

Many industrial and commercial products such as liquid and powered detergents, food mixes, medications and pesticides, sold in bulk form, are dispensed from plastic containers in carefully measured portions. For the customer's convenience, some of these containers are sealed with relatively-large snap-on or screw-on caps specially designed to hold measured amounts of the product desired for each use. Examples of some of these types of containers may be found in the following U.S. Pat. Nos: 4,706,829; 4,917,268 and 4,993,605, to name a few. However, certain products will adhere to and build up in the cap making it difficult to remove and refasten the cap for proper sealing, especially after repeated usage.

Other prior art containers have been devised with removable, separately fabricated measuring cup dispensers, to meet specific requirements of the product and needs of the consumer. For example U.S. Pat. No. 3,526,313 to Kull et al. discloses a food container having a handle with integrally formed slots for convenient attachment of separately fabricated accessories such as a small container and a spoon; U.S. Pat. No. 4,373,640 to Resio discloses a medicine bottle with a combination plastic spoon and screw cap; and U.S. Pat. No. 2,995,265 to Soderberg discloses a spoon which can be snapped on and off the neck of a bottle. Each of these measuring dispensers, being appended to the side of its respective container, is vulnerable to damage in shipping and handling. Therefore, they are all typically packaged in an outer wrapping, or box. U.S. Pat. No. 4,095,716 to Meany, on the other hand, discloses a spoon stored within the container and thus protected from damage. Unfortunately, the handle, as well as the bowl of the spoon, is immersed in the container's contents. While satisfactory for their intended purposes, the above-described container and measuring cup combinations lack the convenience and practicability desired by consumers for certain products sold in bulk form.

OBJECTS OF THE INVENTION

With the forgoing in mind, it is an object of the present invention to provide a novel container and detachable measuring cup combination which overcomes the disadvantages of the prior art by causing the container and the cup to be molded integral with one another and detachable into separate components for enabling the contents of the container to be conveniently measured and dispersed.

Another object of the invention is to provide an integrally formed container having a break-away dispensing cup protected against damage during shipping by being located within a smooth profile of the container body.

Still another object is to provide a container having a blow-molded body and hand grip with a break-away accessory formed in a web extending between the main portion of the body and the grip.

A further object is to provide a unique container and measuring cup combination which utilizes heretofore excess scrap plastic to provide a commercially desirable package for a variety of fluent materials.

A still further object is to provide a plastic container and a measuring cup combination which can be readily mass produced by state-of-the-art molding processes, and which can be transported, stored and displayed in close proximity with like containers but with minimal potential for breakage.

SUMMARY OF THE INVENTION

More specifically, these and other objects of the invention are achieved by providing a container having a detachable measuring and dispensing cup integrally molded within a recess formed in a wall of a main body portion of the container. A weak link connects a portion of the periphery of the cup to the container wall to enable the consumer to break the cup away from the main body. In one preferred embodiment, the cup is formed within a sidewall region bounded by an integral hand grip and interengagable means on the cup and container cooperate to enable the cup to be reassembled with the container body for storage in a non-use position. In this embodiment, the interengageable means includes pairs of small protuberances spaced around the facing sides of the main body and the grip on both sides of the weak link to overlap slightly a lip formed around the cup. This enables the cup to be snapped in and out of place for subsequent storage and use. Alternatively, the interengaging means may be provided on the cap and cup. In another preferred embodiment, the break-away cup is formed integral with the sidewall of the container body in its recessed region and is not bounded entirely by a hand grip, but instead is protected by vertically-spaced juxtaposed overlying and underlying portions of the container sidewall.

BRIEF DESCRIPTION OF THE DRAWINGS

For a better understanding of these and other objects and advantages of the invention, reference will be made to the following detailed description taken in conjunction with the accompanying drawings, in which:

FIG. 1 is a side view in elevation of one preferred embodiment of a container and break-away measuring cup according to the invention;

FIG. 2 is an enlarged fragmentary view of the container of FIG. 1 in the region of the measuring cup;

FIG. 6 is a view in cross-section, like FIG. 4, but illustrating the cup snapped back into place on the container after having been separated;

FIG. 7 is a side elevational view of another preferred embodiment of the invention;

FIG. 8 is a view taken on line 8—8 of FIG. 7;

FIG. 9 is a fragmentary, exploded view of the combination of FIG. 7 but showing the cup removed from the container body.

FIG. 10 is a plan view in reduced scale of an alternate way of securing the measuring cup in a non-use position; and FIG. 11 is a side elevational view of the cap and cup combination illustrated in FIG. 9.

DESCRIPTION OF THE PREFERRED EMBODIMENTS

Figure 3:
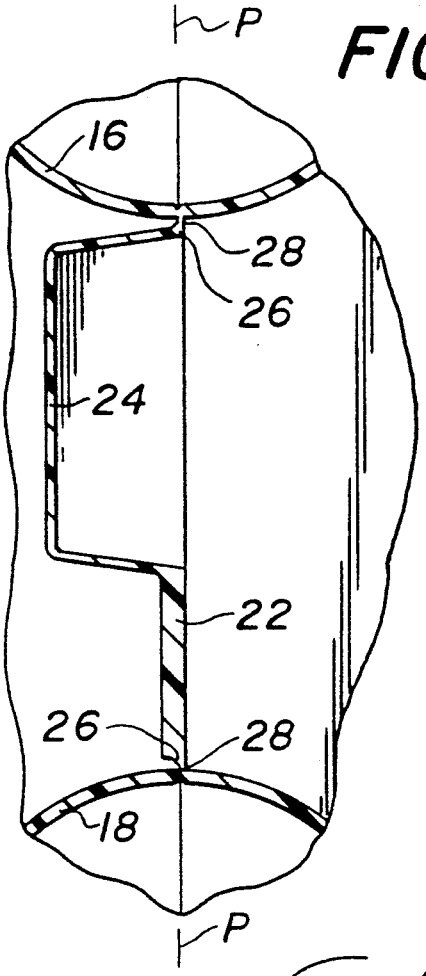
FIG. 3 is a view in cross-section of the container and cup taken along line 3—3 of FIG. 2.

Referring now to the drawings, wherein like reference characters represent like or corresponding parts throughout the several views, FIG. 1 illustrates one preferred embodiment of the present invention. In this embodiment a blow-molded plastic container 10 has a thin main body wall 16 defining a bottom wall portion 11, a side wall portion 13, and a threaded top neck portion 14. The wall 16 forms a rigid hollow interior chamber for containing a fluent material, such as laundry detergent, which can be dispensed from the threaded neck 14 upon removal of the customary threaded closure (not shown). The container wall 16 defines a singular integral molded main body having a hollow elongate hand grip 18 extending in a generally vertical direction. The grip 18 is offset laterally from the longitudinal axis A—A of the container main body 16 and extends in a generally radial plane P (FIG. 3) with respect to the longitudinal axis A—A. The plane P is aligned with the parting line or plane P of the mold cavity and extends through the container 10 on its longitudinal axis. The grip 18 communicates through its opposite ends with upper and lower side wall portions 13*a* and 13*b*, respectively, of the container body 16 to provide a lateral recess for receiving the user's fingers when dispensing contents from the container.

As described thus far, the container is of conventional construction.

According to the present invention, a readily detachable measuring cup 20 is formed integral with the container main body wall 16 during blow-molding and is protected from damage in shipping and handling. To this end, the cup 20 is molded from a web disposed within a lateral recess bounded by upper and lower side wall portions 13*a* and 13*b* and lateral confronting surfaces of the side wall 13 and the grip 18 along the parting line P. In this embodiment the grip 18 connects upper and lower side wall portions 13*a* and 13*b* to form a guard which extends both transversely of the parting plane P and around the outer lateral periphery of the cup 20. Thus, the cup 20 is completely protected from damage and inadvertent disengagement, such as during shipping.

Figure 4:
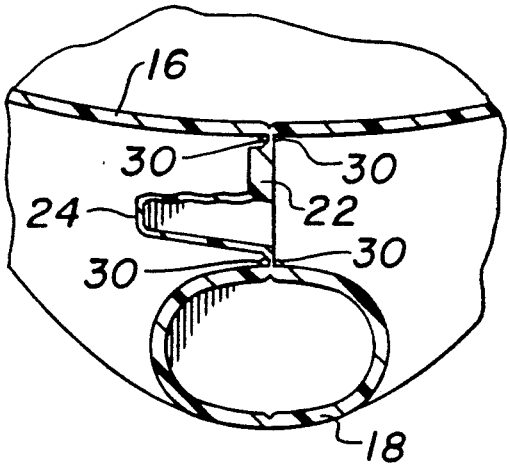
FIG. 4 is a view in cross-section of the container and cup taken along line 4—4 of FIG. 2.
Figure 5:
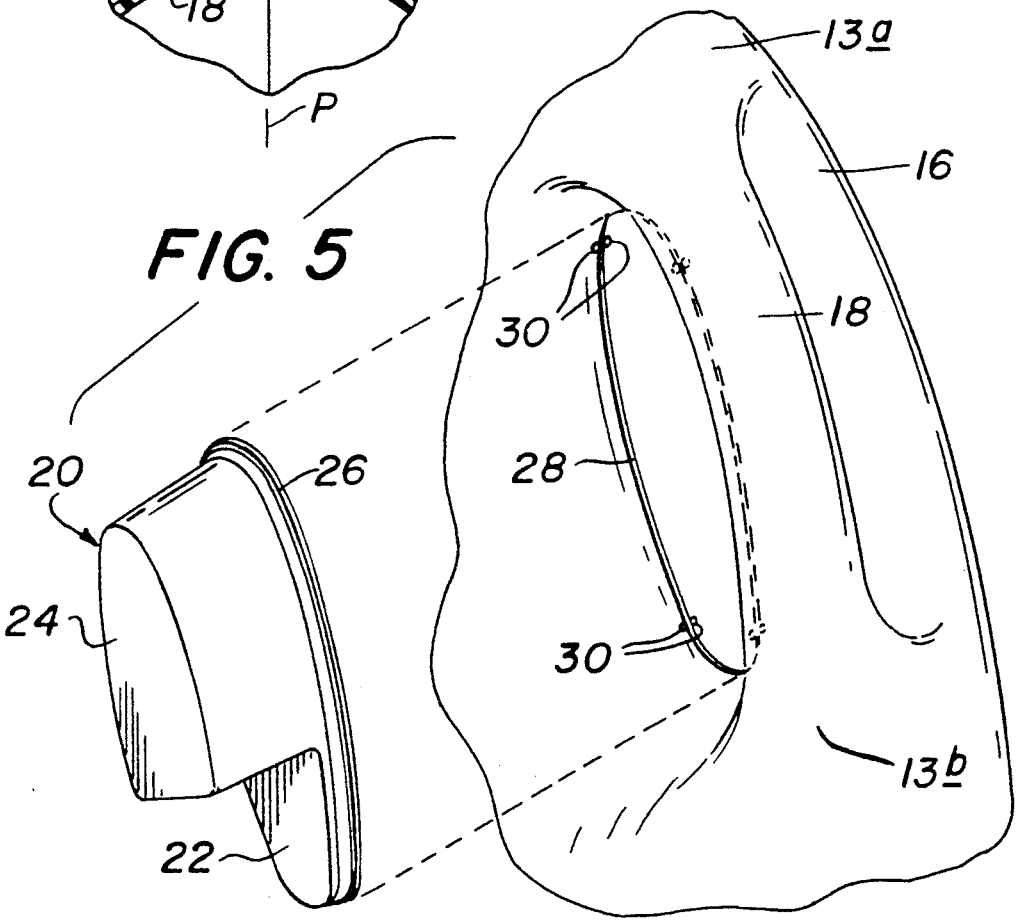
FIG. 5 is a fragmentary perspective view illustrating the cup separated from the container body.

The cup 20 is readily detachable from its stowage position. Referring to the enlarged views in FIGS. 2–4, the cup 20 includes a handle 22 extending upwardly from an integral bowl 24. The periphery of the handle 22 and the brim of the bowl 24 lie substantially in the radial parting plane P extending through the container on its blow-mold parting line. The cup 20 has a continuous lip 26 detachably connected by means of a zone of reduced thickness forming breakable weak link, or frangible bridge, 28 to the confronting lateral surfaces of the container body 16 and the grip 18. The weak link 28 enables the consumer with slight finger pressure perpendicular to the parting plane P to break the cup 20 permanently away from its stowage position between the main body portion 16 and the grip 18, as shown in FIG. 5, for use in measuring and dispensing the fluent contents of the container in the customary fashion.

After the cup 20 has been separated from the container, it may be snapped back into place for convenient stowage as shown in FIG. 6. To this end, interengageable means are provided on the outside of the container body 16 and cup 20. In embodiment illustrated in FIGS. 1–5, the interengageable means is provided by protuberances 30 formed in opposing pairs on the body 16 and the grip 18 at spaced intervals around the periphery of the cup 20 and on opposite sides of the lip 26. The protuberances 30 slightly overlap the lip 26 to capture the cup 20, but there is sufficient resilience in the interengaging components to enable the cup 20 to be snapped in and out with moderate finger pressure.

In the embodiment illustrated in FIGS. 8 and 9, the interengaging means is provided on a container cap 40 and handle 22 of the cup 20. To this end, the container cap 40 is provided with a diametrically-extending slot 40*a* which preferably has a slight dovetail undercut for slidably receiving the cup handle 22. Alternatively, the cap 40 may be provided with protrusions (not shown) that overlie the slot 40*a* and enable the container handle 22 to be snapped into place on the top of the cap 40.

In the preceding embodiment, the hand grip 18 extends along the outer portion of the measuring cup 20 in the plane P when the cup in is stowage position as illustrated in FIG. 1. After the measuring cup 20 has been removed, the grip 18 enables the container 10 to be tilted for dispensing contents in the customary manner with the user's fingers embracing the grip in the palm of the user's hand. Thus, this embodiment is particularly well suited for relatively large containers of fluent material.

There are types of dispensing containers, such as bottles, which are sufficiently slender as to be capable of being gripped by the palm of the hand between the thumb and fingers for dispensing from a top outlet. The present invention is well adapted for use in combination with such containers. To this end, the preferred embodiment illustrated in FIGS. 7 and 8 is provided.

As best seen in FIG. 7, in this embodiment, the container 110 has a generally cylindrical shaped main body wall 116 in side elevation with a flat bottom wall portion 111 and a removable cap 114 providing a closure for a threaded outlet at the top. The side wall 113 of the container body is recessed between an upper portion 113*a* and a lower portion 113*b* for receiving within its vertical and horizontal confines a break-away measuring cup 120. As in the preceding embodiment, the measuring cup 120 is formed from a web of material, 120*a* which is integral with the side wall 11 of the container 110 and extends radially in the plane of the parting line P when the container body is blow-molded. As in the preceding embodiment, the measuring cup 120 has a bowl 124 and a handle 122 is connected to the container body by means of a substantially continuous weakened peripheral zone indicated at 128. The juxtaposed upper and lower side wall portions 113*a* and 113*b* of the container main body 116 provide protection for the cup 120 because the measuring cup 120 is located within both the circular plan profile and vertical profile envelopes of the container body 116. Preferably, as in this illustrated embodiment, the upper side wall portion 113*a* of the container body 116 curves downwardly from the top to accommodate readily the user's hand while dispensing contents from the container. As in the preceding embodiment, suitable interengaging means may be provided on the cup 120 and container body 116 for enabling the cup 120 to be refastened in its stowage position as illustrated after it has been used for measuring.

In both of the aforementioned embodiments, the container bodies are blow-molded of plastic material, such as polyethylene, as well known to those skilled in the art. Blow-molding is accomplished by means of cooperating molds which interengage along a parting line during the molding operation. In both of the aforementioned embodiments, the measuring cups are formed of material which lies in the web extending in the plane of the parting line P. Heretofore, in the manufacture of blow-molded bottles having hand grips, the web material was simply punched-out and either discarded or recycled. In the present invention, however, substantial use of this heretofore excess material is made by converting it into a useful implement, such as a measuring cup. Moreover, the measuring cup is formed in a position in which it is protected from being inadvertently disconnected during shipping and handling yet in which it can be readily detached for use. The combination particularly lends itself to being mass-produced by well-known blow-molding processes, and to shipping and handling with minimal risk of breakage.

It will be understood that various changes in the details, steps and arrangement of parts, which have been herein described and illustrated in order to explain the nature of the invention, may be made by those skilled in the art without departing from the spirit and scope of the invention as expressed in the appended claims.

I claim:

1. A combination dispensing container and break-away measuring cup comprising:

a wall formed into a hollow rigid chamber for containing a fluent material;

said wall having a recessed portion extending into said chamber, said wall also having an outlet permitting fluent material to be dispensed from the chamber;

said measuring cup being formed unitarily with said wall upon manufacture of said container and being retained in a stowage position in said recess until usage is desired; and means including a weakened region of said wall formed upon manufacture of the container and cup for permitting said cup to be detached from said container and removed from said recess for use;

wherein the cup is normally protected from damage during shipment and handling but can be removed readily by finger pressure applied by the ultimate consumer.

2. The combination of claim 1 wherein said recessed portion defines a web extending outwardly from said chamber, and said measuring cup includes a bowl portion formed unitarily with said web.

3. The combination of claim 2 wherein said weakened region of said wall is located in said web between said cup and said chamber.

4. The combination of claim 3 wherein said container wall has a top wall portion with said outlet formed therein and a side wall portion with said recess formed therein, and said web extends laterally outward from said side wall portion.

5. The combination of claim 4 wherein said container side wall portion has juxtaposed portions located above and below said recess for confining therebetween the web and measuring cup formed therein.

6. The combination of claim 5 wherein said juxtaposed portions of said container side wall portion form a hand grip.

7. The combination of claim 5 wherein said juxtaposed portions of said container side wall portion curve toward one another and terminate in spaced relation at opposite ends of said web for receiving therebetween a user's hand after the measuring cup has been removed.

8. The combination of claim 1 wherein said container is of blow-molded plastic construction having a mold parting line defining a plane extending through the chamber, and said break-away measuring cup is molded from a web portion of said wall extending along said parting line.

9. The combination of claim 8 wherein said measuring cup has a handle formed coplanar with said parting line.

10. The combination of claim 1 including interengageable means on said container and said measuring cup for retaining said measuring cup on said container after having been removed from its as-manufactured stowage position in said recess.

11. The combination of claim 1 wherein said container has a cap for closing said outlet, and said cap has means interengageable with said cup for securing said cup in a non-use stowage position.

12. The combination of claim 11 where said cap has a groove, and said cup has a handle releasably received in said groove.

13. A container comprising:

a main body having a hollow interior with a bottom, a side wall having a recessed portion, and a top opening; and an implement disposed in said recessed portion and having a peripheral portion releasably secured to said side wall;

means formed unitarily with said main body and said implement during manufacture for defining a weak link between said peripheral portion of said implement and said recessed portion of said side wall for permitting said implement to be broken away from said main body when force is applied to the implement;

whereby the implement can be detached for use in association with the container.

14. A container according to claim 13 further comprising: an elongate hand grip formed in said container body side wall outward of said implement for cooperating with said side wall when said implement is detached to receive a user's hand to enable dispensing of contents from the container.

15. A container according to claim 13 wherein said implement is a cup for use in measuring contents dispensed from the container.

16. A container according to claim 13 wherein said implement includes a cup for enabling a portion of flowable material dispensed from the container to be measured.

17. A container according to claim 16 wherein said main body and said cup are formed unitarily with one another in a mold having a parting line, and said cup includes a bowl and a handle extending from said bowl in a plane aligned with the parting line of said main body mold.

18. A container according to claim 17 further comprising: protuberances on said container side wall on opposite sides of said peripheral portion of said cup for overlapping said peripheral portion and thereby retaining said cup in a stowage position in said sidewall recess after having been broken away.

19. The container according to claim 13 wherein said container has a cap for closing said top opening, and said cap has means thereon for releasably interengaging said implement to secure it in a non-use stowage position.

20. A blow-molded dispensing plastic container comprising a hollow main body wall defining a chamber for fluent material, said main body wall having a side wall portion recessed inwardly from spaced apart regions of the container; a measuring implement having a peripheral portion formed unitarily with a portion of said side wall during manufacture of the container; and means defining a breakable region interconnecting said peripheral portion with the side wall of said container main body; whereby the measuring implement can be detached from the container body for use in measuring contents dispensed therefrom.

21. The combination of claim 20 further comprising a hand grip extending along said recessed side wall portion between said spaced apart regions to facilitate pouring of the contents of the container.

22. The combination of claim 20 wherein said measuring implement is a cup comprising a bowl and a handle extending from said bowl, and said hand grip is formed unitarily with said container body and cooperates with said recessed sidewall portion both to confine said measuring implement for shipment and stowage and to define an opening for hand insertion after removal of said implement.

23. The combination of claim 20 wherein said measuring implement is a cup comprising a bowl and a handle extending from said bowl, and said cup is formed unitarily with a web portion of said container side wall.

24. The combination of claim 20 including an opening and a removable closure for said opening, and wherein said closure has means thereon cooperable with said measuring implement to releasably secure it in a non-use position.

* * * * *